United States Patent [19]

Dittmann

[11] Patent Number: 4,745,382

[45] Date of Patent: May 17, 1988

[54] ELECTROMAGNETIC RELAY FOR AUTOMATIC ASSEMBLY

[75] Inventor: Michael Dittmann, Berlin, Fed. Rep. of Germany

[73] Assignee: Siemens Aktiengesellschaft, Berlin and Munich, Fed. Rep. of Germany

[21] Appl. No.: 48,434

[22] Filed: May 11, 1987

[30] Foreign Application Priority Data

May 22, 1986 [DE] Fed. Rep. of Germany ..... 3617188

[51] Int. Cl.[4] ..... H01H 67/02

[52] U.S. Cl. ..... 335/128; 335/78; 335/81

[58] Field of Search ..... 335/107, 106, 127, 128, 335/129, 130, 131, 132, 78, 80, 81, 135, 203

[56] References Cited

U.S. PATENT DOCUMENTS

| | | | |
|---|---|---|---|
| 4,254,391 | 3/1981 | Gould | 335/119 |
| 4,267,540 | 5/1981 | Iketani | 335/128 |
| 4,532,487 | 7/1985 | Nagamoto et al. | 335/128 |
| 4,533,889 | 8/1985 | Knight | 335/199 |
| 4,686,506 | 8/1987 | Ide et al. | 335/128 |

FOREIGN PATENT DOCUMENTS

| | | |
|---|---|---|
| 1112786 | 8/1961 | Fed. Rep. of Germany . |
| 2939178 | 5/1980 | Fed. Rep. of Germany . |
| 3428595 | 2/1986 | Fed. Rep. of Germany . |

OTHER PUBLICATIONS

European Search Report.

*Primary Examiner*—E. A. Goldberg
*Assistant Examiner*—Lincoln Donovan
*Attorney, Agent, or Firm*—John F. Moran

[57] ABSTRACT

A relay comprises a spool with flanges (2, 3), an angular yoke (7) and an angular armature (9) positioned in front of the free end of the yoke (7). A contact element (8) attached to the free end of the yoke is provided for contacting of the relay spring (10*c*), which is connected with said armature. During the assembly process an armature assembly including an armature (9), connecting element (8) and leaf spring (10) is preassembled and subsequently mounted as a single unit onto the yoke (7). Since all connecting elements are connected with the spool or with the yoke, additional soldering to the base is not required. This physical configuration enables a fully automatic production of the relay.

40 Claims, 4 Drawing Sheets

ELECTROMAGNETIC RELAY FOR AUTOMATIC ASSEMBLY

BACKGROUND OF THE INVENTION

This invention relates to electromagnetic relays, and it relates, more particularly, to electromagnetic relays wherein the axis of the coil extends parallel to the connecting surface of the relay, with at least one stationary opposite contact element mounted in a first flange of the spool and a winding support in both flanges respectively.

A conventional relay of this type is disclosed in German patent document DE-OS No. 34 28 595. In this document, the terminal elements take the form of flat plugs and are essentially anchored in a base and subsequently connected in the spool, together with associated electrical elements. These electrical connecting elements, for example, between the winding supports inside the spool flanges and the corresponding plug and socket connections or between the relay spring and its terminal elements inside the base, require additional processes which cannot be easily automated. The assembly of the armature with its bearing spring is particularly unsuited to automated production.

SUMMARY OF THE INVENTION

It is an object of the present invention to provide a relay of the foregoing type having a construction or configuration so that it can be produced by using simpler components and by means of simpler processes.

It is a related object of the relay arrangement enabling it to be manufactured extensively by automated production.

In accordance with the subject invention, this problem is solved in that a separate connecting piece is attached to the free end of the second yoke leg, thus providing a support for the armature and a mounting section for the leaf spring, as well as the one-piece contact element for the leaf spring, and that the winding support points are formed directly by the coil contact elements anchored in the respective spool flange.

The additional connecting piece, according to the invention, is connected mechanically and electrically with the yoke. Not only does it serve to provide contact with the relay spring connected with the armature, but also to support and secure the armature. Above all, this connecting piece enables an automated assembly of the armature. Unlike conventional relays of similar design, the armature is no longer required to be aligned with the assembled yoke and attached via its bearing spring. On the contrary, the armature including leaf spring can, in the process of preassembly, be aligned with and attached to the connecting piece; and, due to the separation from yoke and coil, the process can easily be automatically performed by robots.

In a further simplification of the process, the preassembled connecting piece together with the armature and leaf spring is mounted onto the yoke, which is connected with the spool and simply placed from the side against the second yoke leg and connected therewith, for example by means of a weld or a similar joint. Because the terminal element for the relay spring is therefore connected through the yoke with the spool, and the coil terminal elements are anchored in the spool flange and thus serve directly as winding supports, and in addition an opposite contact element may be anchored in a coil flange. Furthermore, a relay of this type, while being in a state of operative readiness, may be assembled on the spool. A base, which is inserted via the terminal pins, has in this instance, merely the function of a housing seal in the direction of the connecting side. Additional soldered joints between functional components located in the spool and other functional components located in the base are, therefore, not required. Only when further opposite contacts are required for a changeover contact of for a bridge contact, said further opposite contacts are anchored in a base. Nor is a subsequent soldered joint required following the insertion of the base.

For practical purposes, the connecting piece forms an angle, with at least one longitudinal section located laterally at the second leg, and at least one transverse section at the free face of the second yoke leg. In a suitable development the connecting piece is so designed that the second yoke leg engages with an offset extension between bifurcated webs of the connecting piece. In a special development the longitudinal section of the connecting piece is provided with two connecting tabs which are bent at right angles and mounted first on the second yoke leg, and between said connecting tabs, a fastening tab for the leaf spring. For practical purposes, the fastening tab for the leaf spring has a clearance in the direction of the yoke leg, as well as a design bending point. By this method, the leaf spring connected to said yoke leg, for example by means of welding, can be adjusted by bending the fastening tabs.

In a preferred illustrative embodiment the armature is angled, and the bearing leg of said armature is positioned at the extension of the second yoke leg. The terminal element for the leaf spring can be attached to the connecting piece via an intermediate strip which extends between the coil winding and the armature or the second yoke leg and is connected via a conductive cross-section with the connecting piece essentially in the region of the upper yoke edge.

BRIEF DESCRIPTION OF THE DRAWING

Features of the invention and additional objects of the invention will be more readily appreciated and better understood by reference to the following detailed description which should be considered in conjunction with the drawing.

DETAILED DESCRIPTION

Figure 1:
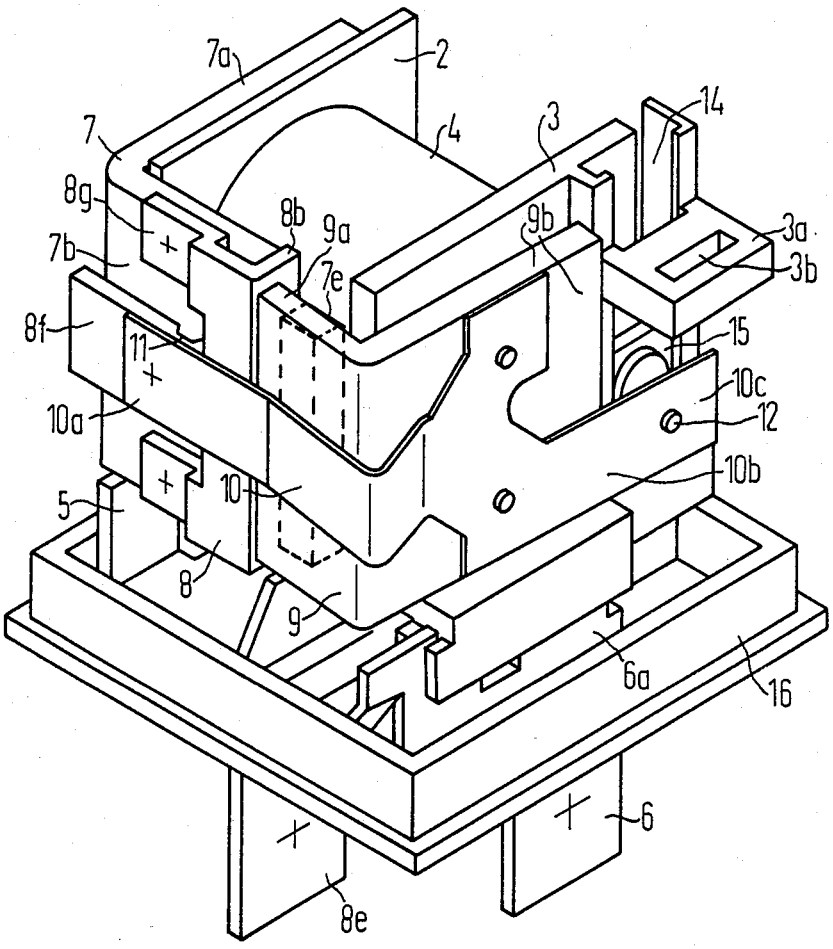
FIG. 1 illustrates a perspective view of a relay in accordance with the principles of the invention.
Figure 2:
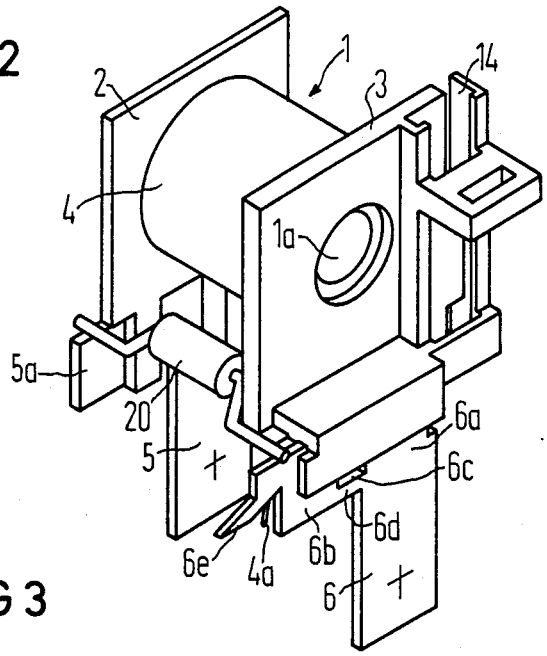
FIG. 2 depicts a spool for the relay in accordance with FIG. 1.
Figure 3:
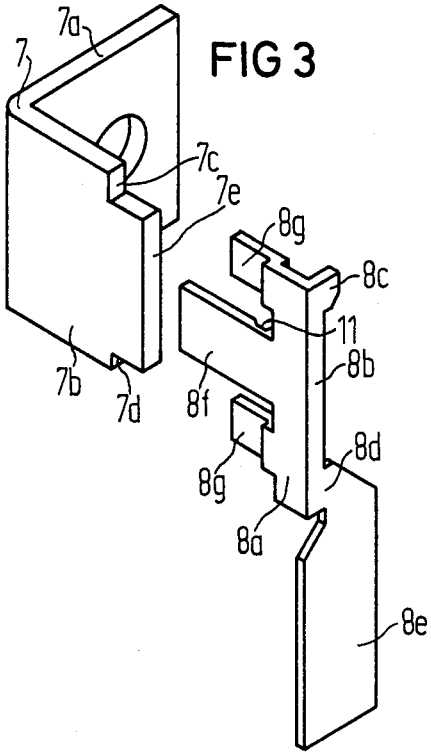
FIG. 3 demonstrates the state of a yoke and a connecting piece prior to assembly.

The relay shown in FIGS. 1 through 3 has a supporting element in the form of a spool 1 comprising two flanges 2 and 3 and one winding 4, while in each of the coil flanges a coil terminal element 5 or 6 is mounted.

These coil terminal elements 5 and 6 can be injected into the spool. In this illustrative embodiment of the relay, these elements are plugged into the respective grooves of the respective coil flange by means of a transverse web 5*a* or 6*a*, or by means of an extension of the coil flange. The spool is provided with an axial throughhole 1*a* for the purpose of inserting a core (not shown) which is connected in the region of the coil flange 2 with a yoke 7. Yoke 7 is shaped in the form of an angle, with the leg 7*a* being connected with the aforesaid core while the leg 7*b* extends adjacent to the coil winding approximately parallel to the axis of said coil winding, without extending to the full length of the coil. Attached to the free end of the yoke leg 7*b* is a connecting piece 8 which basically forms an angle. At the same time, the longitudinal section 8*a* of the connecting piece extends parallel to the yoke leg 7*b*, whereas the transverse section 8*b* of the connecting piece, together with two bifurcated attached webs 8*c* and 8*d*, is adjacent to the free faces of the yoke leg 7*b*, i.e., free faces 7*c* and 7*d*. At the same time, the webs 8*c* and 8*d* of the connecting piece like a fork encompass an extension 7*e* serving as a support for the bearing of the armature 9. Fitted to the underside of the web 8*d* is a contact terminal pin 8*e*.

The armature 9 is developed in the form of an angle and is positioned together with its leg 9*a* in the angle formed between the transverse leg 8*b* of the connecting piece and the extension 7*e* of the yoke. The second armature leg 9*b* is arranged at the face in front of the coil flange 3, approximately perpendicular to the coil axis; and it forms an operating air gap with the aforesaid core (not shown). The leaf spring 10 serves as a support and a way to reset the armature, which, together with a reset leg 10*a*, is attached to the connecting piece 8, and, together with the armature support leg 10*b*, is attached to the armature leg 9*b*, and with its free end forms a relay spring leg 10*c* which is extended beyond the open armature end. Due to the angular shape of the armature 9 the center of its rotation is displaced from the contact plane, thus producing an increase in contact friction, resulting in a self-cleansing action.

Figure 5:
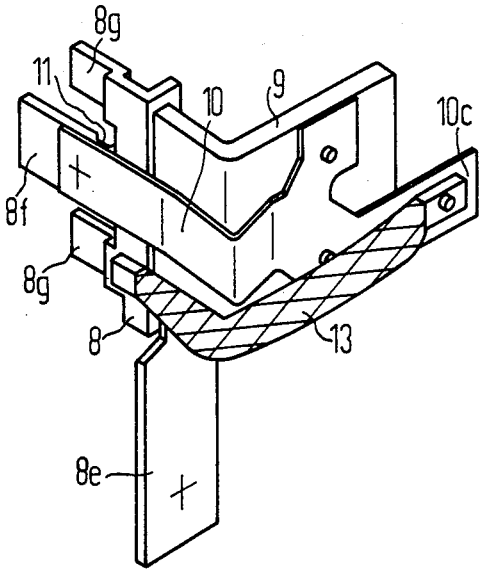
FIG. 5 is a preassembled armature assembly with a connecting piece.

In the relay assembly, first the yoke 7 is connected with the spool 1, while the armature assembly including armature 9, connecting piece 8, and leaf spring 10 is preassembled and subsequently set down as a single unit upon the yoke or connected with the yoke leg 7*b*. The preassembled armature assembly is shown in FIG. 5, which shows that the leaf spring 10, together with its reset leg 10*a*, is welded on a central mounting leg 8*f*, which is located between two connecting tabs 8*g* and the connecting piece 8. The two connecting tabs 8*g* are offset out in the direction of the yoke leg 7*b*, so that the fastening tab 8f has a clearance in the direction of the yoke leg 7*b* and thus can be bent for adjusting the leaf spring 10 or the armature 9. In order to facilitate this adjustment through bending, design bending point 11, which has a reduced material cross-section, is provided at the fastening tab 8*f*. According to FIG. 5, the preassembled armature assembly is mounted on the yoke 7 connected with the spool and welded together with the yoke leg 7*b* through the connecting tabs 8*g*. Of course, the aforesaid joints can also be secured or fastened together by other known methods such as soldering or riveting. The foregoing adjustment by way of bending the fastening tab 8f is done after the armature assembly is placed on the yoke or following the assembly of additional opposite contacts.

By connecting the leaf spring 10 with the piece 8, the relay spring 10*c* is also connected with the corresponding terminal element 8*e*. If specific tasks require the switching of extremely high currents, it may be practical to connect the contact member 12 of the relay spring 10*c* directly via a flexible conductive element, for example through a stranded wire 13 as shown in FIG. 5, with the connecting piece 8.

Figure 4:
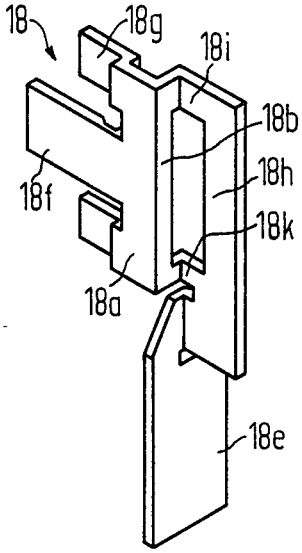
FIG. 4 illustrates a modified connecting piece.

FIG. 4 illustrates a modification to connecting piece 8. The response in the relay can also be increased by the modified connecting piece 8. There the terminal element 18*e* is not attached directly to the transverse leg 18*b*. On the contrary, the connecting piece is provided with an additional intermediate strip 18*h* which essentially overlaps the web 18*i* at the transverse leg 18*b*. It is true that the underside is provided with a further web 18*k* for reasons of stability; but the cross-section of said web is so dimensioned that it provides a high resistance for the switching current which flows from the terminal element 18*e* to the leaf spring 10, so that a major portion of the current flows via the web 18*i*.

Figure 6:
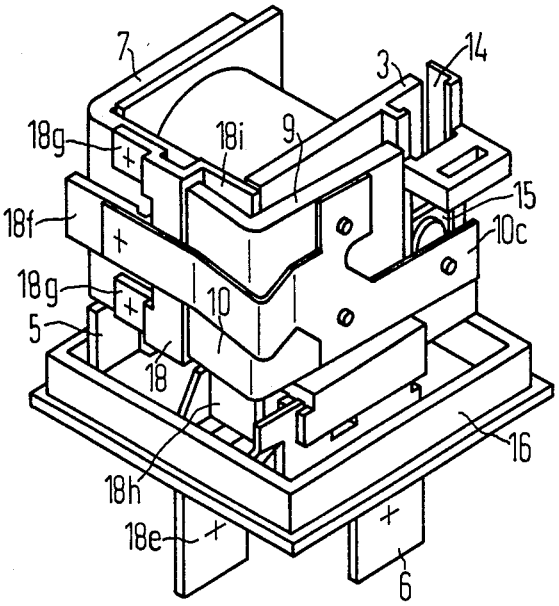
FIG. 6 demonstrates a somewhat modified embodiment of a relay shown in FIG. 1.

FIG. 6 illustrates an assembled relay fitted with such a connection piece 18 as depicted in FIG. 5. From this it is clear that in this instance the switching current flows via the terminal element 18*e* and the intermediate web 18*h* to the lateral leg 18*a* of the connecting piece and from there via the leaf spring 10 (or in reverse order), so that the current it conducted in an almost complete loop around the extension of the yoke 7*e* or the armature leg 9*a*, and thus generates an additional induction current. While providing the circuit contacts with suitable polarity, this additional flow adds to the induction current of the coil winding 4. Especially at the moment of response of the relay, when a peak switching current is active, the starting motion of the armature is thus supported by this additional induction current. This is particularly advantageous in the event that both the induction current as well as the switching current are drawn from a common d.c. source, for example a car battery. In such an event there might otherwise be the risk that a high starting current may possibly cause the breakdown of the battery voltage and the armature would not start safely due to a reduction in the induction current. The above described development of the connecting piece 18 thus permits an improved safe response of the relay.

As is shown in FIG. 1, the spool flange 3 is provided with a plug-in shaft 14 for accomodating the opposite contact 15, which functions together with the contact member 12 of the relay spring 10*c*. A terminal element (not shown) is attached to the opposite contact 15. According to FIG. 1, all functional elements of the relay are thus attached to the spool or indirectly connected therewith, so that, after these components have been mounted to the spool, the relay becomes operative. There then remains only the base 16 to be plugged in from beneath through the terminal elements, for example 6 and 8*e*, while a housing cover (not shown) is placed on top of the unit.

Figure 7:
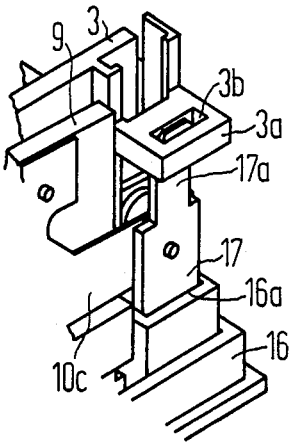
FIGS. 7 and 8 are each sectional views of modified contact configurations for a relay constructed in accordance with FIG. 1.
Figure 8:
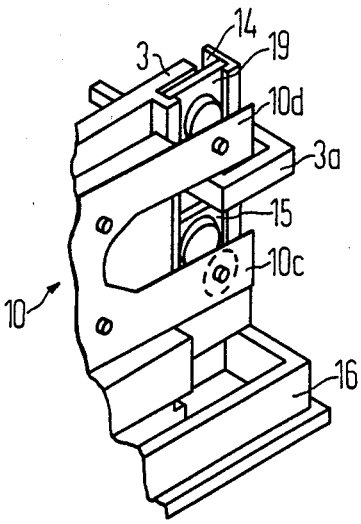

However, the relay may have a plurality of modifications of the contact configuration as is shown, for example, in FIGS. 7 and 8. For example an off-set 3*a*, having an opening 3*b* for accomodating a further opposite contact element 17, is attached at the spool flange 3. As is shown in FIG. 7, the opposite contact element 17 is mounted in a plug-in shaft 16*a* of the base 16, and during assembly of the base this opposite contact is inserted with an extension 17*a* into the opening 3*b*. This enables a good positioning of the opposite contact element 17 which, according to FIG. 7, is an element of the change-over contact; this method further ensures low-bounce switching of the break-make contact pair.

FIG. 8 demonstrates a further modification of the contact configuration. Here the plug-in shaft 14 has been inserted with an additional opposite contact element 19 which functions together with an additional leg 10*d* of the leaf spring 10. In the event that the opposite contact element 19 is provided with its own connection, the configuration, according to FIG. 8, is a bridge contact configuration, so that the connecting piece 8 is not required to perform a conducting function. However, it is also possible to connect the opposite contact element 19 with the opposite contact element 15, so as to achieve the function of a twin contact. At the same time the contact clearance between the contact element 19 and the spring leg 10*d*, as well as between the opposite contact element 15 and the spring leg 10*c*, can be varied, thus creating an early contact. Apart from this, other modifications of the contact configuration are possible.

Figure 9:
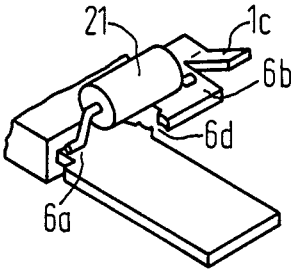
FIG. 9 shows a series-connected diode in between the contact and the coil.

In addition, the relay can be assembled with other components, for example resistors or diodes which are connected in series or parallel to the coil winding. FIG. 2 thus illustrates an embodiment in which a parallel component 20 is arranged between the two coil flanges 2 and 3 with terminals which are respectively welded or soldered to the transverse webs 5*a* or 6*a* of the coil connecting elements 5 or 6. Said components can also be connected in series. For this purpose, the transverse web 6*a* is provided with a notch 6*c*, so that a support tab 6*b* is anchored separately in the coil flange 3 and connected with a connecting element 6 only by means of a narrow web 6*d*. If, for example, a diode 21 is to be series-connected in front of the coil winding, the web 6*d* is cut and the diode 21 at the rear of the connecting element 6 is welded onto the cut webs 6*a* and 6*b*, as is shown in FIG. 9. FIG. 2 and FIG. 9 also show the mounting and contacting of the winding terminal 4*a* requires the bending of a tab 6e adjacent to which the winding terminal 4*a* is nipped and then soldered. The opposite winding terminal is correspondingly mounted and contacted at a tab of the connecting element 5.

There has thus been shown and described novel relay constructions which fulfill all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

I claim:

1. An electromagnetic relay including a coil containing a spool having an axis which runs parallel to a connecting surface of the relay, at least one stationary contact element attached to a first flange of two flanges on the spool and the spool supports a winding between the two flanges, the relay comprising:

a core having two ends inserted into the spool and oriented in the direction of the axis;

a generally L-shaped yoke whose first leg is fastened to one of the two ends of the core and whose second leg extends parallel to the axis of the coil and has a free end adjacent to the winding;

an armature located in front of the free end of the second yoke leg to form an air gap with the other one end of the core;

a leaf spring mounted on the armature providing support for the armature opposite the yoke by means of a reset leg and at least one leg extending adjacent to the contact element; and the leaf spring being electrically conductive and having a terminal element connected thereto and at least one contact for contacting the stationary contact element;

two coil terminal elements for the winding each anchored in a respective spool flange for supporting the coil while electrically connecting to the winding; and a connecting piece joined to the free end of the second yoke leg having a fastening tab for the leaf spring and providing a support for the armature, and being said terminal element for the leaf spring.

2. A relay according to claim 1, wherein the connecting piece is angled and has at least one longitudinal section attached laterally to the second yoke leg and at least one cross-section attached to the free face of the second yoke leg.

3. A relay according to claim 2, wherein the second yoke leg engages with an offset extension between bifurcated webs of the connecting piece.

4. A relay according to claim 1, wherein the longitudinal section of the connecting piece includes two connecting tabs bent at right angles and mounted flat on the second yoke leg and a fastening tab for the leaf spring between said connecting tabs.

5. A relay according to claim 3, wherein the longitudinal section of the connecting piece includes two connecting tabs bent at right angles and mounted flat on the second yoke leg and a fastening tab for the leaf spring between said connecting tabs.

6. A relay according to claim 4, wherein the fastening tab has a clearance in the direction of the yoke leg as well as a design bending point.

7. A relay according to claim 5, wherein the fastening tab has a clearance in the direction of the yoke leg as well as a design bending point.

8. A relay according to claim 3, wherein the armature is angled, and a bearing leg of the armature is positioned at said offset extension of the second leg of the yoke.

9. A relay according to claim 4, wherein the armature is angled, and a bearing leg of the armature is positioned at the offset extension of the second leg of the yoke.

10. A relay according to claim 6, wherein the armature is angled, and a bearing leg of the armature is positioned at the offset extension of the second leg of the yoke.

11. A relay according to claim 2, wherein said terminal element is connected to said connecting piece via an intermediate strip which extends between the coil and the armature and is connected with the connecting piece essentially only near the upper edge of the yoke through a conductive web with a large cross-section.

12. A relay according to claim 3, wherein said terminal element is connected to said connecting piece via an intermediate strip which extends between the coil and the armature and is connected with the connecting piece essentially only near the upper edge of the yoke through a conductive web with a large cross-section.

13. A relay according to claim 4, wherein said terminal element is connected to said connecting piece via an intermediate strip which extends between the coil and the armature and is connected with the connecting piece essentially only near the upper edge of the yoke through a conductive web with a large cross-section.

14. A relay according to claim 6, wherein said terminal element is connected to said connecting piece via an intermediate strip which extends between the coil and the armature and is connected with the connecting piece essentially only near the upper edge of the yoke through a conductive web with a large cross-section.

15. A relay according to claim 1, wherein the winding support points are formed from the coil terminal elements as exposed soldering tabs.

16. A relay according to claim 2, wherein the winding support points are formed from the coil terminal elements as exposed soldering tabs.

17. A relay according to claim 3, wherein the winding support points are formed from the coil terminal elements as exposed soldering tabs.

18. A relay according to claim 4, wherein the winding support points are formed from the coil terminal elements as exposed soldering tabs.

19. A relay according to claim 6, wherein the winding support points are formed from the coil terminal elements as exposed soldering tabs.

20. A relay according to claim 1, wherein between the two coil terminal elements is provided a component which is shunt connected to the winding.

21. A relay according to claim 2, wherein between the two coil terminal elements is provided a component which is shunt connected to the winding.

22. A relay according to claim 3, wherein between the two coil terminal elements is provided a component which is shunt connected to the winding.

23. A relay according to claim 4, wherein between the two coil terminal elements is provided a component which is shunt connected to the winding.

24. A relay according to claim 6, wherein between the two coil terminal elements is provided a component which is shunt connected to the winding.

25. A relay according to claim 1, wherein one of the coil terminal elements has two sections anchored in the coil flange, which are connected outside the coil flange via a removable web.

26. A relay according to claim 2, wherein one of the coil terminal elements has two sections anchored in the coil flange, which are connected outside the coil flange via a removable web.

27. A relay according to claim 3, wherein one of the coil terminal elements has two sections anchored in the coil flange, which are connected outside the coil flange via a removable web.

28. A relay according to claim 4, wherein one of the coil terminal elements has two sections anchored in the coil flange, which are connected outside the coil flange via a removable web.

29. A relay according to claim 6, wherein one of the coil terminal elements has two sections anchored in the coil flange, which are connected outside the coil flange via a removable web.

30. A relay according to claim 20, wherein one of the coil terminal elements has two sections anchored in the coil flange, which are connected outside the coil flange via a removable web.

31. A relay according to claim 1, wherein the coil flange supporting the opposite contact element has an off-set for supporting the opposite contact anchored in the base.

32. A relay according to claim 2, wherein the coil flange supporting the opposite contact element has an off-set for supporting the opposite contact anchored in the base.

33. A relay according to claim 3, wherein the coil flange supporting the opposite contact element has an off-set for supporting the opposite contact anchored in the base.

34. A relay according to claim 4, wherein the coil flange supporting the opposite contact element has an off-set for supporting the opposite contact anchored in the base.

35. A relay according to claim 6, wherein the coil flange supporting the opposite contact element has an off-set for supporting the opposite contact anchored in the base.

36. A relay according to claim 20, wherein the coil flange supporting the opposite contact element has an off-set for supporting the opposite contact anchored in the base.

37. A relay according to claim 1, wherein a plug-in shaft is formed in the coil flange and two opposite contact elements are arranged in said plug-in shaft in a common plane one above the other so as to provide a bridge contact or twin contact.

38. A relay according to claim 2, wherein a plug-in shaft is formed in the coil flange and two opposite contact elements are arranged in said plug-in shaft in a common plane one above the other so as to provide a bridge contact or twin contact.

39. A relay according to claim 4, wherein a plug-in shaft is formed in the coil flange and two opposite contact elements are arranged in said plug-in shaft in a common plane one above the other so as to provide a bridge contact or twin contact.

40. A relay according to claim 6, wherein a plug-in shaft is formed in the coil flange and two opposite contact elements are arranged in said plug-in shaft in a common plane one above the other so as to provide a bridge contact or twin contact.

* * * * *